US006984929B1

(12) United States Patent
Tagami et al.

(10) Patent No.: US 6,984,929 B1
(45) Date of Patent: Jan. 10, 2006

(54) COLOR PICTURE TUBE APPARATUS WITH PINCUSHION DISTORTION CORRECTION

(75) Inventors: Etsuji Tagami, Osaka (JP); Toshihiko Shichijyo, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/576,188

(22) Filed: May 23, 2000

(30) Foreign Application Priority Data

May 24, 1999 (JP) ..... 11-142873

(51) Int. Cl.
*H01J 29/74* (2006.01)
*H01J 29/70* (2006.01)

(52) U.S. Cl. ..... 313/437; 313/412; 313/440

(58) Field of Classification Search ..... 313/437, 313/440, 412; 315/402, 407, 399, 370
See application file for complete search history.

(56) References Cited

U.S. PATENT DOCUMENTS

| | | | | |
|---|---|---|---|---|
| 4,818,919 A | | 4/1989 | Kobayashi et al. | |
| 4,876,479 A | * | 10/1989 | Kawabata et al. | 313/440 |
| 4,961,021 A | * | 10/1990 | Oguro et al. | 313/412 |
| 5,039,923 A | * | 8/1991 | Ogino et al. | 315/382 |
| 5,070,280 A | * | 12/1991 | Okuyama et al. | 313/412 |
| 5,260,627 A | * | 11/1993 | Yokota et al. | 315/400 |
| 5,355,050 A | * | 10/1994 | Sluyterman | 313/413 |
| 5,804,928 A | | 9/1998 | Endo | 315/400 |
| 5,936,363 A | * | 8/1999 | Ogura | 315/371 |

FOREIGN PATENT DOCUMENTS

| | | |
|---|---|---|
| CN | 87 1 07475 | 5/1988 |
| EP | 0 588 666 | 3/1994 |
| EP | 0 776 125 | 5/1997 |
| JP | 1-175150 | 7/1989 |
| JP | 1-183042 | 7/1989 |
| JP | 9-149283 | 6/1997 |

OTHER PUBLICATIONS

Copy of the Chinese Office Action.

* cited by examiner

*Primary Examiner*—Nimeshkumar D. Patel
*Assistant Examiner*—Matt Hodges
(74) *Attorney, Agent, or Firm*—Hamre, Schumann, Mueller & Larson, P.C.

(57) ABSTRACT

A color picture tube apparatus having a system for increasing an upper and lower pincushion distortion in the peripheral portion in the vertical direction by making the preliminary vertical deflection force when an electron beam is deflected toward the peripheral portion in the vertical direction of a phosphor screen relatively smaller than the preliminary vertical deflection force when an electron beam is deflected toward the middle portion in the vertical direction of the phosphor screen. With the color picture tube apparatus using an S-shaped distortion correction circuit, an upper and lower inner pincushion distortion can be optimized while correcting the upper and lower pincushion distortion.

2 Claims, 4 Drawing Sheets

COLOR PICTURE TUBE APPARATUS WITH PINCUSHION DISTORTION CORRECTION

FIELD OF THE INVENTION

The present invention relates to a color picture tube apparatus, and more particularly to a means for correcting an inner pincushion distortion on the upper and lower sides of a screen.

BACKGROUND OF THE INVENTION

A raster distortion is one of the important factors in determining the image quality of a color picture tube. Conventionally, pincushion distortions on the upper and lower sides and the right and left sides of the outer periphery have been corrected by a magnetic field of the deflection yoke and a correction circuit of the color picture tube apparatus. Even if these distortions in the upper and lower sides or the right and left sides of the outer periphery are corrected optimally, a pincushion distortion may remain in the longitudinal line or the lateral line in the middle portion of a screen. Such distortions are referred to as "right and left inner pincushion distortion" (shown in FIG. 8) and "upper and lower inner pincushion distortion" (shown in FIG. 9), respectively ("left and right inner pincushion distortion" also may be referred to as "longitudinal line pincushion distortion" or "right and left inner luminescent line distortion," and "upper and lower inner pincushion distortion" also may be referred to as "lateral line inner pincushion distortion" or "upper and lower inner luminescent line distortion").

In general, the displacement magnitude X(t) of a luminescent spot on a flat screen is proportional to tan θ where θ is a deflection angle. Therefore, the amount of the horizontal deflection is increased closer to the peripheral portion in the horizontal direction of a phosphor screen. That is, a non-linear distortion called "S-shaped distortion" occurs. This S-shaped distortion is corrected by adding an S-shaped distortion correction circuit. The amount of correction necessary for correcting the S-shaped distortion is inversely proportional to the distance from the deflection center to each spot on the phosphor screen. As shown in FIG. 7, the upper and lower parts of the raster of the color picture tube, i.e., a peripheral portion 72 in the vertical direction of the phosphor screen (hereinafter "peripheral portion" will be referred to) is more distant from the deflection center as compared with the other portions, that is, a middle portion 71 in the vertical direction of the phosphor screen (hereinafter, "middle portion" will be referred to). Accordingly, the amount of the correction necessary for correcting the S-shaped distortion for the peripheral portion may be smaller than that for the middle portion.

In the conventional color picture tube apparatus, although the S-shaped distortion correction circuit can optimize the S-shaped distortion correction in the middle portion in the vertical direction of the phosphor screen, the difference in the necessary correction amount between the middle portion and the peripheral portion in the vertical direction of the phosphor screen has not been considered. Therefore, the S-shaped distortion is over-corrected in the peripheral portion, thus causing the right and left inner pincushion distortion. In particular, a trend toward flattening the front panel of the color picture tube and larger deflection angle have made the right and left inner pincushion distortion significant.

In order to solve such problems, for example, JP 9-149283A discloses a configuration in which a horizontal deflection current is allowed to flow through a saturation reactor and is modulated by a vertical deflection current, thus reducing the total inductance of the horizontal deflection portion when an electron beam is deflected toward the upper and lower portion of the raster, thereby excluding the right and left inner pincushion distortion.

With further flattening of the front panel and larger deflection angle in recent color picture tubes, the difference in the amount of the S-shaped distortion correction between the left or right peripheral portion and the middle portion in the horizontal direction of the raster increases, as well as the difference in the vertical direction of the raster. Consequently, in addition to the right and left inner pincushion distortion, the upper and lower inner pincushion distortion has been a significant problem.

The above-mentioned conventional inner pincushion distortion correction circuit disclosed in JP 9-149283A is an effective means for correcting the right and left inner pincushion distortion, but the means could not correct the upper and lower inner pincushion distortion. Therefore, the conventional means for correcting the distortion only can balance the distortion amount between the upper portion and the lower portion by an upper and lower tilting operation, that is, by tilting the central axis of the deflection yoke in the vertical direction.

SUMMARY OF THE INVENTION

It is an object of the present invention to provide a system capable of correcting the upper and lower inner pincushion distortion while correcting the upper and lower pincushion distortion in the color picture tube apparatus using the conventional S-shaped distortion correction circuit.

In order to achieve the above-mentioned object, the color picture tube apparatus according to the present invention includes a color picture tube provided with an electron gun and a phosphor screen on which an electron beam emitted from the electron gun impacts, in a bulb including a front panel and a funnel, and a deflection yoke attached to a neck portion of the bulb and deflecting the electron beam, wherein an upper and lower pincushion distortion in the peripheral portion in the vertical direction is increased by making the preliminary vertical deflection force when an electron beam is deflected toward the peripheral portion in the vertical direction of the phosphor screen relatively smaller than the preliminary vertical deflection force when an electron beam is deflected toward the middle portion in the vertical direction of the phosphor screen, and the upper and lower pincushion distortion in the peripheral portion in the vertical direction is corrected by a deflection magnetic field generated by the deflection yoke, thereby correcting an upper and lower inner pincushion distortion in the middle portion in the vertical direction.

According to such a configuration of the present invention, the upper and lower pincushion distortion in the peripheral portion in the vertical direction of the phosphor screen is increased intentionally thus to reduce the difference between the upper and lower pincushion distortion of the peripheral portion and the upper and lower inner pincushion distortion in the middle portion. Thereby, it is possible to correct the upper and lower pincushion distortion in the peripheral portion and the upper and lower inner pincushion distortion in the middle portion by a deflection magnetic field.

It is preferable in the above-mentioned configuration that the color picture tube apparatus further includes a correction coil mounted at the electron gun side of the deflection yoke, for providing the electron beam with the preliminary deflection force, wherein a vertical deflection current flows through the correction coil when the electron beam is deflected toward the peripheral portion in the vertical direction of the phosphor screen, but a vertical deflection current does not flow through the correction coil when the electron beam is deflected toward the middle portion in the vertical direction, and the correction coil generates a preliminary deflection magnetic field opposing to the vertical deflection magnetic field by the current flowing when the electron beam is deflected toward the peripheral portion in the vertical direction.

According to such a configuration of the present invention, the preliminary deflection force can be increased or decreased in synchronization with the vertical deflection. Furthermore, by appropriately adjusting the timing for allowing the vertical deflection current to flow through the correction coil, it is possible to increase or decrease the preliminary deflection force between the peripheral portion and the middle portion in the vertical direction.

More specifically, it is preferable that at least a pair of the correction coils provided at right and left sides of the neck portion so that the correction coils sandwich the electron beam in the horizontal direction, a circuit in which at least two diodes are connected in parallel having opposite polarities with each other, and vertical deflection coils of the deflection yoke are connected in series, and the vertical deflection current flows through the correction coil via the conduction of the diodes when the electron beam is deflected toward the peripheral portion in the vertical direction of the phosphor screen.

According to such a configuration of the present invention, it is possible to control the preliminary deflection force only by adding a connector including at least two diodes to the correction coil, thus achieving a small size upper and lower inner pincushion distortion correction circuit at low cost.

Furthermore, according to the present invention, a color picture tube apparatus includes a color picture tube provided with an electron gun and a phosphor screen on which electron beam emitted from the electron gun impacts, in a bulb including a front panel and a funnel, a deflection yoke attached to a neck portion of the bulb and deflecting the electron beam, and a correction coil provided at the electron gun side in the deflection yoke and providing the electron beam with a preliminary deflection force, wherein at least a pair of the correction coils provided at right and left sides of the neck portion so that the correction coils sandwich the electron beam in the horizontal direction, a circuit in which at least two diodes are connected in parallel having opposite polarities with each other, and vertical deflection coils of the deflection yoke are connected in series, and the vertical deflection current flows through the correction coil via a conduction of the diode when the electron beam is deflected toward the peripheral portion in the vertical direction of the phosphor screen, but vertical deflection current does not flow through the correction coil when the electron beam is deflected toward the middle portion in the vertical direction, and the correction coil generates the preliminary deflection magnetic field opposing to the vertical deflection magnetic field by the current that flows when the electron beam is deflected toward the peripheral portion in the vertical direction.

According to such a configuration of the present invention, the preliminary deflection force can be increased or decreased in synchronization with the vertical deflection. Furthermore, it is possible to control the preliminary deflection force only by adding a connector including at least two diodes to the correction coil, thus realizing a small size upper and lower inner pincushion distortion correction circuit at low cost.

DETAILED DESCRIPTION OF THE INVENTION

Hereinafter, the present invention will be described by way of embodiments with reference to drawings. In the color picture tube apparatus of the present invention, since the structures other than a deflection yoke are well known, drawings and explanations for them are not described herein.

Figure 2:
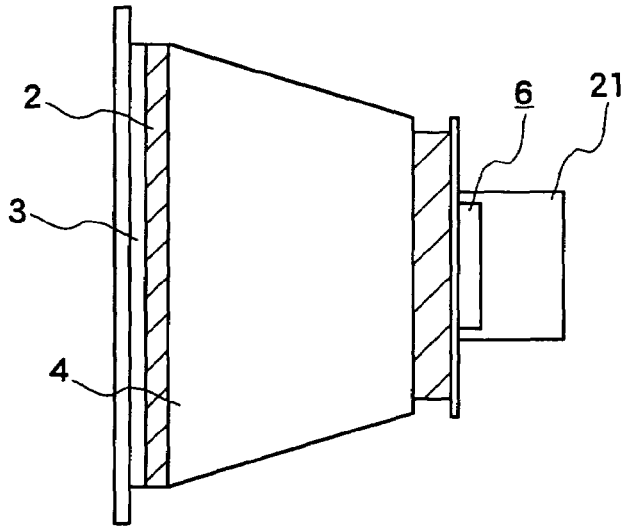
FIG. 2 is a side view showing a deflection yoke used for a color picture tube apparatus according to the embodiment of the present invention.
Figure 3:
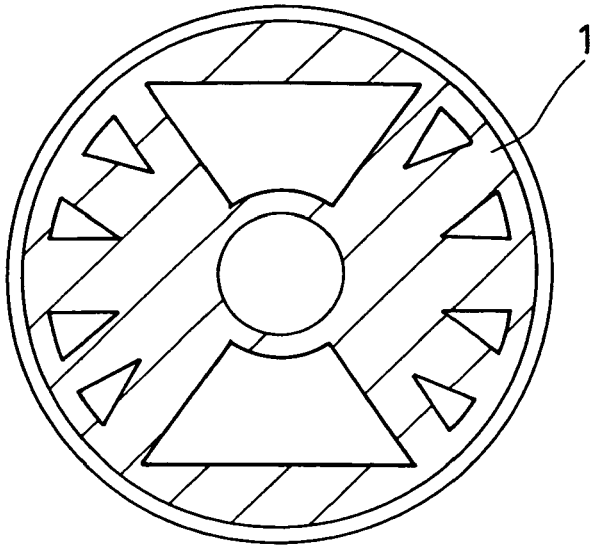
FIG. 3 is a view of the deflection yoke of FIG. 2 seen from the side of a phosphor screen.
Figure 4:
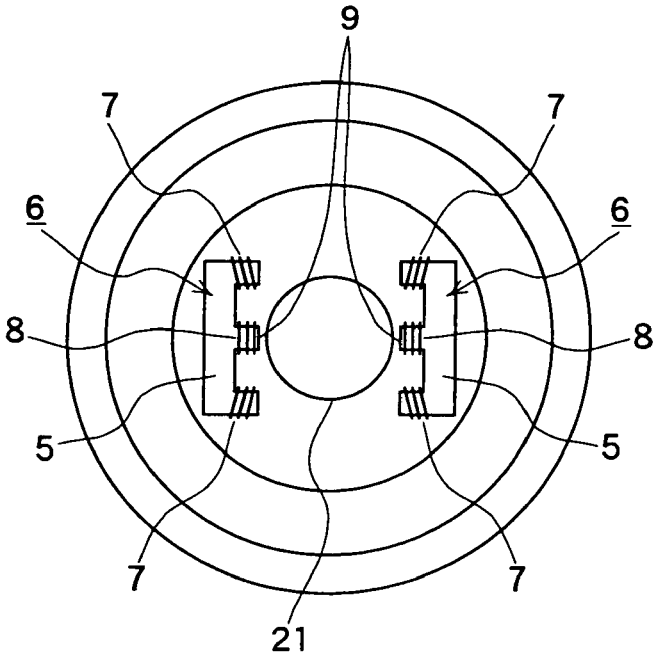
FIG. 4 is a view of the deflection yoke of FIG. 2 seen from the side of an electron gun.

FIG. 2 is a side view showing a deflection yoke. FIG. 3 is a view showing the deflection yoke seen from the side of a phosphor screen, and FIG. 4 is a view showing the deflection yoke seen from the side of an electron gun according to the present invention, respectively. As shown in FIGS. 2 to 4, the deflection yoke includes a horizontal deflection coil 1, a vertical deflection coil 2, an insulation frame 3 for insulating and fixing the horizontal and vertical deflection coils 1 and 2, a ferrite core 4 provided at the outside of the vertical deflection coil 2, and a correction coil 6 provided at the end portion at the electron gun side.

As shown in FIG. 4, the correction coil 6 is constructed by winding conductive wires around an E-shaped core 5. The correction coil 6 includes a coma correction coil 7 for correcting the coma-aberration in the vertical direction of the phosphor screen and an inner pincushion distortion correction coil 8. The correction coil 6 is fixed to the end portion at the electron gun side of the insulation frame 3 so that central leg portions 9 of the E-shaped cores 5 are positioned in the vicinity of a neck portion 21 of the color picture tube.

Figure 5:
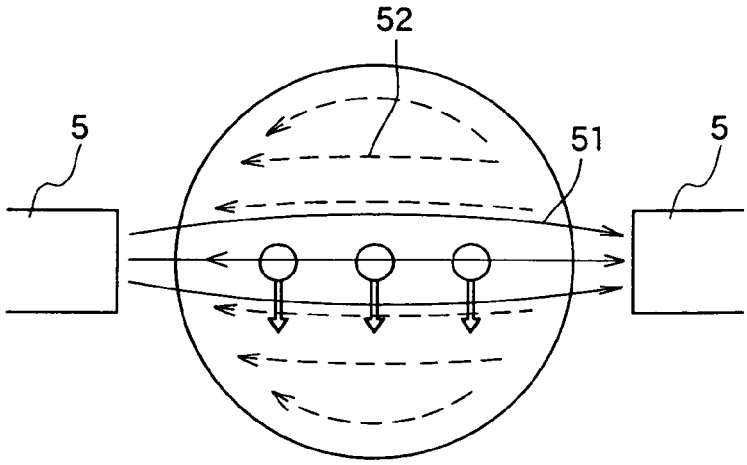
FIG. 5 is a view showing the direction of the preliminary deflection magnetic filed generated by the inner pincushion distortion correction coil of the present invention.

The inner pincushion correction distortion coil 8 is wound around the central leg portion 9 of the E-shaped core 5 and generates a magnetic field in the direction opposite to the vertical defection magnetic field. FIG. 5 shows a direction of the magnetic field 51 (shown by solid lines) generated by the inner pincushion distortion correction coil 8 when the electron beam is deflected upward in the phosphor screen. When the electron beam is deflected upward, a magnetic field is generated by the inner pincushion distortion correction coil 8 in a direction opposite to the vertical deflection magnetic field 52 (shown by broken lines), i.e. in a direction in which an electron beam is deflected downward. This correction magnetic field works to weaken the preliminary deflection force in the vertical direction of the electron beam at the electron gun side.

Figure 1:
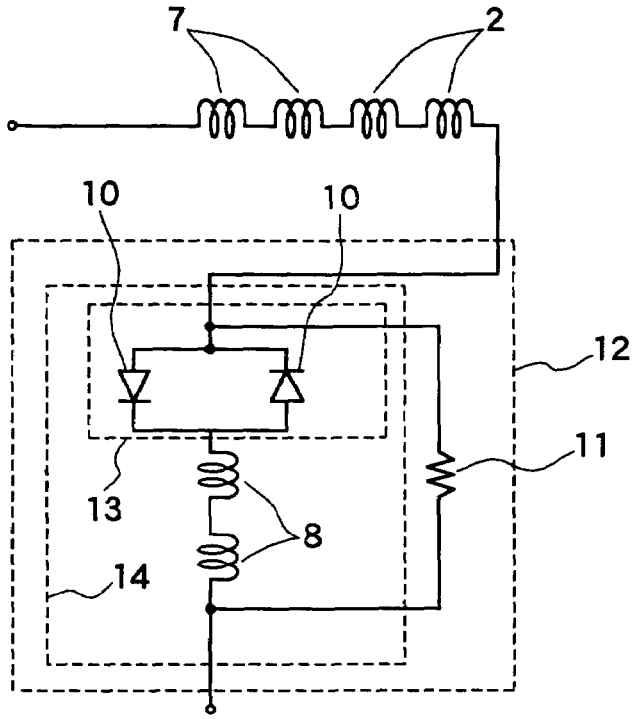
FIG. 1 is a diagram showing an inner pincushion distortion correction circuit that is one of the main parts of a color picture tube apparatus according to an embodiment of the present invention.

Next, a circuit in which the inner pincushion distortion correction coil 8 is connected will be explained. As shown in FIG. 1, a pair of diodes 10 are connected in parallel having reverse polarities with each other to form a diode parallel circuit 13. The diode parallel circuit 13 and the inner pincushion distortion correction coil 8 are connected in series to form a diode—coil series circuit 14. The diode—coil series circuit 14 and a fixed resistor 11 are connected in parallel to form an inner pincushion distortion correction circuit 12. The inner pincushion distortion correction circuit 12 and a vertical deflection coil 2 are connected in series. Furthermore, a coma correction coil 7 and the vertical deflection coil 2 are connected in series.

Hereinafter, the operation of the inner pincushion distortion correction coil 12 will be explained.

Figure 6:
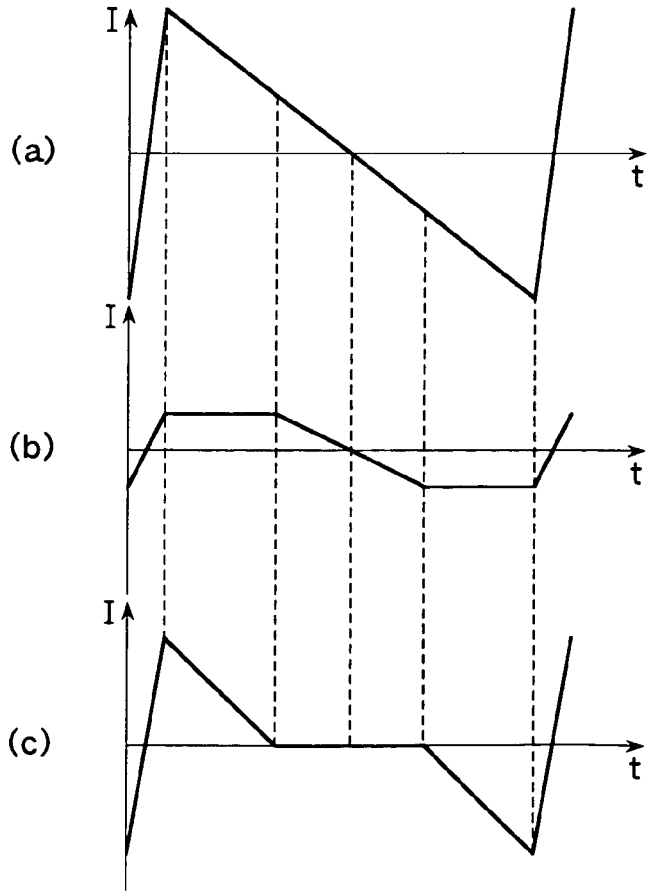
FIG. 6 shows a current flowing through the circuit of FIG. 1, where (a) shows a waveform of a vertical deflection current, (b) shows a waveform of a current flowing through a fixed resistor, and (c) shows a waveform of a current flowing through an inner pincushion distortion correction coil.
Figure 7:
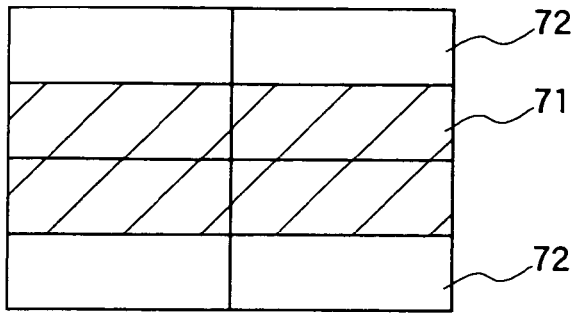
FIG. 7 is a view to explain a peripheral portion and a middle portion in the vertical direction of the phosphor screen.
Figure 8:
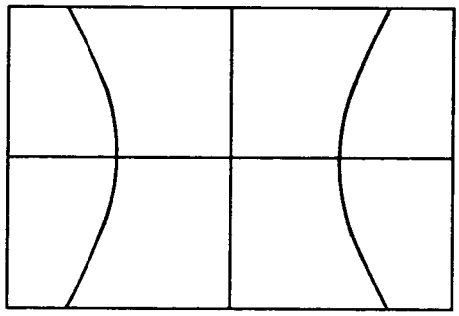
FIG. 8 is a view to explain a right and left inner pincushion distortion.
Figure 9:
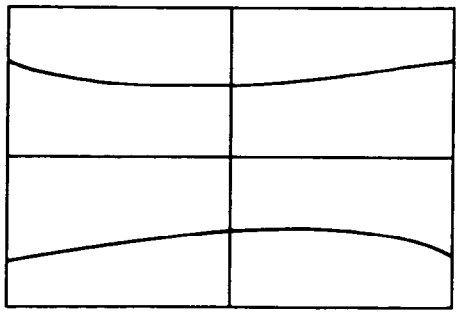
FIG. 9 is a view to explain an upper and lower inner pincushion distortion.

In the inner pincushion distortion correction circuit 12, a vertical deflection current having a sowtooth waveform flows as shown in FIG. 6(*a*). The vertical deflection current has to be considered by dividing the screen into two portions, such as a large current flowing portion, i.e., the peripheral portion 72 and the other middle portion 71 as shown in FIG. 7.

In the middle portion 71, since the voltage applied to the both ends of the diode 10 of the diode parallel circuit 13 is not more than the switching voltage, current scarcely flows through the diode 10. Accordingly, a current does not flow through the inner pincushion distortion correction coil 8. Consequently, the coil does not operate. Most of the current flowing through the inner pincushion distortion correction circuit 12 flows through the fixed resistor 11 at this time. FIG. 6 (b) shows a waveform of the current flowing through the fixed resistor 11.

On the other hand, in the peripheral portion 72, since the voltage applied to the both ends of the diode 10 in the diode parallel circuit 13 is more than the switching voltage, a current flows through the diode 10 and also through the inner pincushion distortion correction coil 8. Consequently, the coil operates. FIG. 6(*c*) shows a waveform of the current flowing through the inner pincushion distortion correction coil 8.

As shown in FIG. 5, when the inner pincushion distortion coil 8 operates, the preliminary deflection force in the vertical direction of the electron beam at the electron gun side is weakened. It is conventionally known that when the preliminary deflection force is weakened, the upper and lower pincushion distortion on the phosphor screen is increased. In the conventional deflection yoke, contrary to the present invention, it was common that the upper and lower pincushion distortion is reduced by strengthening the preliminary deflection force in the vertical direction of the electron beam at the electron gun side.

In the present invention, the inner pincushion distortion correction coil 8 does not operate when the electron beam is deflected toward the middle portion, but operates when the electron beam is deflected toward the peripheral portion. As a result, the upper and lower pincushion distortion is increased in the peripheral portion. This is equivalent to the condition that the upper and lower pincushion distortion in the middle portion is reduced relative to the peripheral portion. In this operation, when the upper and lower pincushion distortion is optimized by adjusting a magnetic field generated by the horizontal deflection coil and vertical deflection coil, the upper and lower pincushion distortion in the middle portion is also reduced accordingly. In general, the magnetic fields are adjusted in the manner that the pincushion magnetic field at the phosphor screen side of the horizontal deflection coil and vertical deflection coil is strengthened. In order to strengthen the pincushion magnetic field, the coil winding of the horizontal deflection coil is concentrated on the direction of the horizontal axis and the coil winding of the vertical deflection coil is concentrated on the direction of the vertical axis, respectively.

Next, an experiment in which the effect of the color picture tube apparatus for a 46 [m] (19 inches) display of the present invention was confirmed will be described. The E-shaped core used herein was a 3 mm-thick ferrite core. A conductive wire was wound 80 times around a 7 mm-wide central leg portion 9 to form the inner pincushion distortion correction coil 8. For the diode 10, a silicon diode was used. For the fixed resistor 11, a resistor of 2.7 Ω was used.

When the inner pincushion distortion correction coil 8 is directly connected to the vertical deflection coil 2 without using the diode 10, the upper and lower pincushion distortion was 0.2% and the lateral line inner pincushion distortion was 0.9%. The lateral line inner pincushion distortion was quite large. On the contrary, when the inner pincushion distortion correction coil 8 was operated in the inner pincushion distortion correction circuit 12 of the present invention, the upper and lower pincushion distortion was 0.3% and the lateral line inner pincushion distortion was 0.4%. Therefore, it was possible to improve the lateral line inner pincushion distortion while maintaining the upper and lower pincushion distortion at the same level as the above-mentioned comparative example.

In the embodiment mentioned above, the E-shaped core was used for the correction coil. However, an I-shaped core or a U-shaped core may be used. Besides the inner pincushion distortion correction, when the upper and lower pincushion distortion tends to be large, it is preferable that the U-shaped coil is used for the coma aberration correction coil 7. Because the case where the U-shaped core instead of the E-shaped core is used for the coma aberration correction coil, the preliminary deflection force tends to be increased in general. In this case, for the inner pincushion distortion correction coil 8, the I-shaped coil may be used.

As mentioned above, according to the present invention, it is possible to provide a high performance color picture tube capable of correcting the lateral inner pincushion distortion while optimizing the upper and lower pincushion distortion.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color picture tube apparatus comprising:

a color picture tube provided with an electron gun having three electron beam critters and a phosphor screen on which electron beams emitted from said electron beam emitters impact, in a bulb including a front panel and a funnel;

a deflection yoke attached to a neck portion of said bulb and deflecting said electron beams; and a pair of correction coils having an inner pincushion distortion correction coil and being provided at both sides of said electron gun in said deflection yoke and formed of cores with flat tip ends facing each other and conductive wires wound around the respective cores, the flat tip ends forming therebetween a magnetic field in the direction opposite to the vertical defection magnetic field so as to provide said electron beams with a preliminary deflection force in a vertical direction, wherein a pair of diodes are connected in parallel having reverse polarities with each other to form a diode parallel circuit, the diode parallel circuit and the inner pincushion distortion correction coil are connected in series to form a diode coil series circuit, the diode coil series circuit and a resistor are connected in parallel to form an inner pincushion distortion correction circuit, and the inner pincushion distortion correction circuit and a vertical deflection coil are connected in series.

2. The color picture tube apparatus according to claim 1, wherein the correction coil comprises an F-shaped core.

* * * * *